US009696003B2

(12) United States Patent
Chai

(10) Patent No.: US 9,696,003 B2
(45) Date of Patent: Jul. 4, 2017

(54) MULTI-DIRECTIONAL LED LAMP

(71) Applicant: Kao-Teh Chai, Taipei (TW)

(72) Inventor: Kao-Teh Chai, Taipei (TW)

( * ) Notice: Subject to any disclaimer, the term of this patent is extended or adjusted under 35 U.S.C. 154(b) by 21 days.

(21) Appl. No.: 14/849,610

(22) Filed: Sep. 10, 2015

(65) Prior Publication Data

US 2016/0215953 A1 Jul. 28, 2016

(30) Foreign Application Priority Data

Jan. 28, 2015 (TW) ..... 104102869 A

(51) Int. Cl.

| | |
|---|---|
| ***F21V 3/00*** | (2015.01) |
| ***F21V 3/02*** | (2006.01) |
| ***F21V 29/83*** | (2015.01) |
| ***F21V 23/00*** | (2015.01) |
| ***F21V 17/16*** | (2006.01) |
| ***F21K 9/23*** | (2016.01) |
| ***F21K 9/232*** | (2016.01) |
| *F21Y 115/10* | (2016.01) |

(52) U.S. Cl.

CPC ..... *F21V 3/02* (2013.01); *F21K 9/23* (2016.08); *F21K 9/232* (2016.08); *F21V 17/164* (2013.01); *F21V 23/009* (2013.01); *F21V 29/83* (2015.01); *F21Y 2115/10* (2016.08)

(58) Field of Classification Search

CPC ..... F21K 9/23; F21K 9/232; F21V 17/164; F21V 23/009; F21V 23/007; F21V 29/83; F21V 3/02; F21V 7/0016; F21Y 2115/10

See application file for complete search history.

(56) References Cited

U.S. PATENT DOCUMENTS

| | | | | |
|---|---|---|---|---|
| 8,405,289 | B2 * | 3/2013 | Chang | F21V 3/00 313/46 |
| 8,421,320 | B2 * | 4/2013 | Chuang | F21V 29/83 313/46 |
| 8,807,792 | B2 * | 8/2014 | Cho | F21V 7/0058 362/235 |

(Continued)

FOREIGN PATENT DOCUMENTS

| | | |
|---|---|---|
| CN | 101509653 A | 8/2009 |
| CN | 201748229 U | 2/2011 |

(Continued)

*Primary Examiner* — Peggy Neils

(74) *Attorney, Agent, or Firm* — CKC & Partners Co., Ltd.

(57) ABSTRACT

A multi-directional LED lamp includes a cooling cylinder, a lamp housing unit, a lamp housing unit, a lamp cap, LED lighting unit, a driving circuit board, and a transparent lampshade unit. The transparent lampshade unit is assembled at the bottom of the cooling cylinder and covers the LED lighting unit, and a cross-sectional area of the transparent lampshade unit is greater than a cross-sectional area of the cooling cylinder, thereby outwardly protrudes from the cooling cylinder. The transparent lampshade unit includes a lower transparent lampshade and an upper transparent lampshade. The light emitting from the LED lighting unit radiates in a direction of an opposite side of the lamp cap through the lower transparent lampshade, and a part of the light reflected by the lower transparent lampshade and transmit toward a direction of the lamp cap through the upper transparent lampshade, to achieve a goal of the multi-directional lighting.

6 Claims, 6 Drawing Sheets

(56) References Cited

U.S. PATENT DOCUMENTS

| | | | | |
|---|---|---|---|---|
| 9,255,674 | B2 * | 2/2016 | Grajcar | F21V 29/75 |
| 2012/0038260 | A1 | 2/2012 | Lu et al. | |
| 2012/0187818 | A1 | 7/2012 | Chuang | |
| 2014/0268803 | A1 * | 9/2014 | Keng | F21V 5/04<br>362/294 |
| 2015/0211723 | A1 * | 7/2015 | Athalye | F21V 29/77<br>362/294 |
| 2016/0186981 | A1 * | 6/2016 | Chen | F21K 9/232<br>362/373 |

FOREIGN PATENT DOCUMENTS

| | | | |
|---|---|---|---|
| EP | 2320137 | A1 | 5/2011 |
| EP | 2789893 | A1 | 10/2014 |
| TW | 200907233 | A | 2/2009 |
| TW | 201207296 | A | 2/2012 |
| WO | 2006/118457 | A1 | 11/2006 |
| WO | 2012/122095 | A2 | 9/2012 |

* cited by examiner

MULTI-DIRECTIONAL LED LAMP

RELATED APPLICATIONS

This application claims priority to Taiwan Application Serial Number 104102869, filed Jan. 28, 2015, which is herein incorporated by reference.

BACKGROUND

Field of Invention

The present invention relates to a LED lamp. More particularly, the present invention relates to a multi-directional LED lamp.

Description of Related Art

Since the Light Emitting Diode (LED) has the advantages of small size, low power consumption, fast response time, rich colors, and environmentally friendly, it has become an important lighting element in modern life. LED has also been widely used for the lighting of the lamps, to further form a LED lamp, such as a LED bulb.

A LED bulb using the LED as the light source has a lamp cap connector wherein the lamp cap connector connects to a driving circuit board. Since the lamp cap is the same as the lamp cap of the traditional tungsten lamp, it has the usage convenience to be assembled on the traditional lamp holder directly.

Generally the LED bulb typically contains a cooling lamp holder, a lamp cap, a LED lighting unit, a lampshade and a driving circuit board. The LED lighting unit is installed at an end of the cooling lamp holder and is covered by the lampshade. The driving circuit board is arranged at the other end of the cooling lamp holder, and is electrically connected to the LED lighting unit and the lamp cap. The heat generated by the light emitting unit passes out from the cooling lamp holder.

The elements of the LED lamp such as the driving circuit board and the cooling lamp holder are often located on the side of the lampshade facing towards the lamp cap, thereby the light emitted from the LED lighting unit in a direction towards the lamp cap will be covered by the cooling lamp holder. That is, the light emitted from the LED lighting unit can merely only radiate in a direction of the opposite side of the lamp cap, and is incapable of radiating toward a direction of the lamp cap, thus forming a dark area at the direction of the lamp cap and reducing its lighting performance.

SUMMARY

The invention provides a multi-directional LED lamp, which has the advantage of multi-direction radiating.

According to an aspect of the present invention, a multi-directional LED lamp is provided, the multi-directional LED lamp includes: a cooling cylinder, a lamp housing unit assembled at a top of the cooling cylinder, a lamp cap assembled at a top of the lamp housing unit, a LED lighting unit installed in an interior of the cooling cylinder, a driving circuit board installed in an interior of the lamp housing unit and electrically connected to the lamp cap and the LED lighting unit, and a transparent lampshade unit assembled at a bottom of the cooling cylinder and covering the LED lighting unit, wherein a cross-sectional area of the transparent lampshade unit is greater than a cross-sectional area of the cooling cylinder, to outwardly protrude from the cooling cylinder.

According to an exemplary embodiment of the present invention, the transparent lampshade unit includes an upper transparent lampshade and a lower transparent lampshade, the lower transparent lampshade assembled at a bottom of the upper transparent lampshade.

According to an exemplary embodiment of the present invention, the upper transparent lampshade is a convex lampshade, which includes an upper inner wall, a flat shade body and a lower outer wall connected in order, an inner wall of the lower outer wall has a plurality of inner notches spaced to each other. The lower transparent lampshade is a bowl lampshade, which has a bowl shade body and a convex wall connecting around the bowl shade body, the convex wall has a plurality outer hook bodies spaced to each other, and each of the outer hook bodies engaged in each of the inner notches separately.

According to an exemplary embodiment of the present invention, wherein the cooling cylinder has an annular wall, the annular wall has a first outer end and an opposite second outer end, the annular wall has a plurality of air channels running from the first outer end to the second outer end, and between the interior of the cooling cylinder is a transverse carrier plate, where the LED lighting unit is installed at a basal plane of the transverse carrier plate.

According to an exemplary embodiment of the present invention, wherein a first annular groove is set at a bottom of an inner wall of the annular wall of the cooling cylinder, the upper inner wall of the transparent lampshade unit has a plurality of first engaging sections spaced to each other, each of the first engaging sections is engaged with the first annular groove.

According to an exemplary embodiment of the present invention, wherein the lamp housing unit includes an upper lamp housing and a lower lamp housing, the lower lamp housing is assembled on a basal plane of the upper lamp housing, an interior of the upper lamp housing and an interior of the lower lamp housing form a containing room, wherein the driving circuit board is installed in the containing room.

According to an exemplary embodiment of the present invention, wherein a second annular groove is set at a top of an inner wall of the annular wall of the cooling cylinder, a bottom of the upper lamp housing of the lamp housing unit has a plurality of second engaging sections spaced to each other, each of the second engaging sections is engaged with the second annular groove.

According to an exemplary embodiment of the present invention, wherein the LED lighting unit has a substrate and a plurality of LEDs installed on the substrate.

According to the multi-directional LED lamp of the present invention, a cross-sectional area of a transparent lampshade unit is greater than a cross-sectional area of the cooling cylinder, and which protrudes from a cross-sectional of the cooling cylinder, in this way, the light emitting from the LED lighting unit radiates in a direction of an opposite side of the lamp cap through the lower transparent lampshade, a part of the light reflected by the lower transparent lampshade and transmits toward a direction of the lamp cap through the upper transparent lampshade, to achieve a goal of the multi-directional lighting and solving the problems of a dark area at the direction of the lamp cap.

BRIEF DESCRIPTION OF THE DRAWINGS

The invention can be more fully understood by reading the following detailed description of the embodiment, with reference made to the accompanying drawings as follows.

DESCRIPTION OF THE EMBODIMENTS

Figure 1:
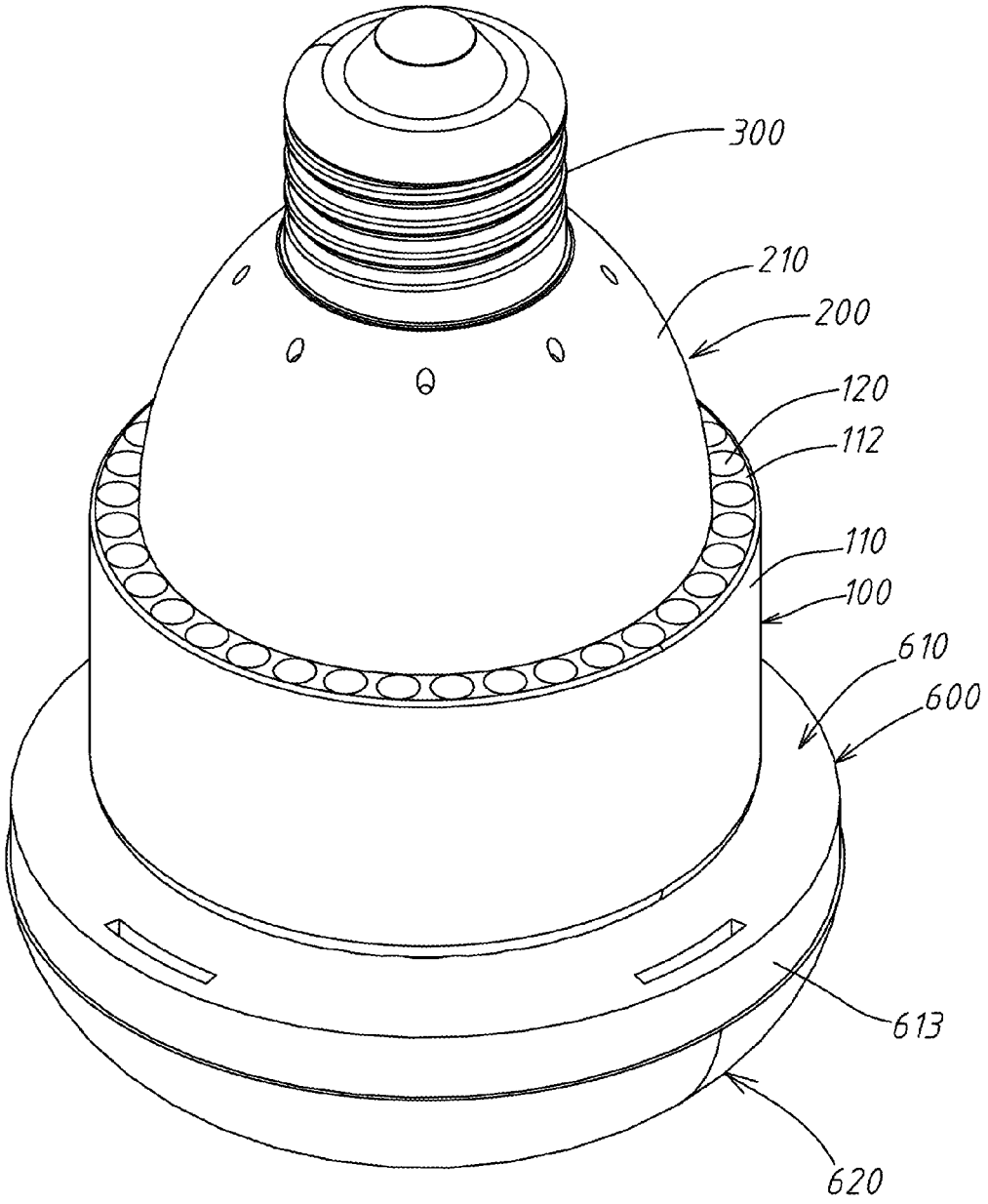
FIG. 1 is a perspective view of the appearance of a multi-directional LED bulb according to an exemplary embodiment of a multi-directional LED bulb of the present invention.
Figure 2:
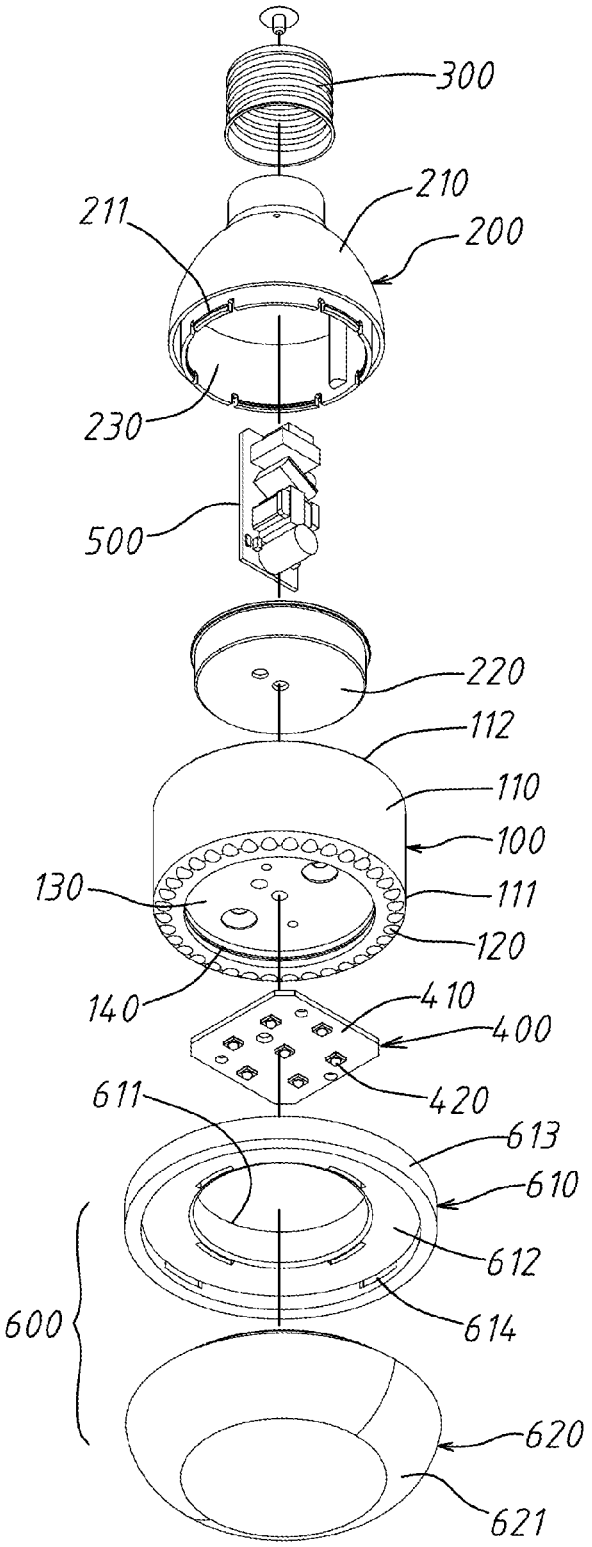
FIG. 2 is an exploded view of the multi-directional LED bulb in FIG. 1.
Figure 6:
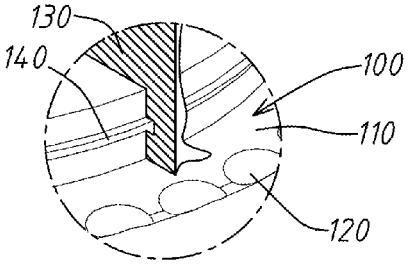
FIG. 6 is an enlarged view of part C of the multi-directional LED bulb in FIG. 3.
Figure 5:
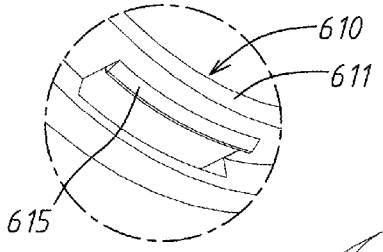
FIG. 5 is an enlarged view of part B of the multi-directional LED bulb in FIG. 3.
Figure 3:
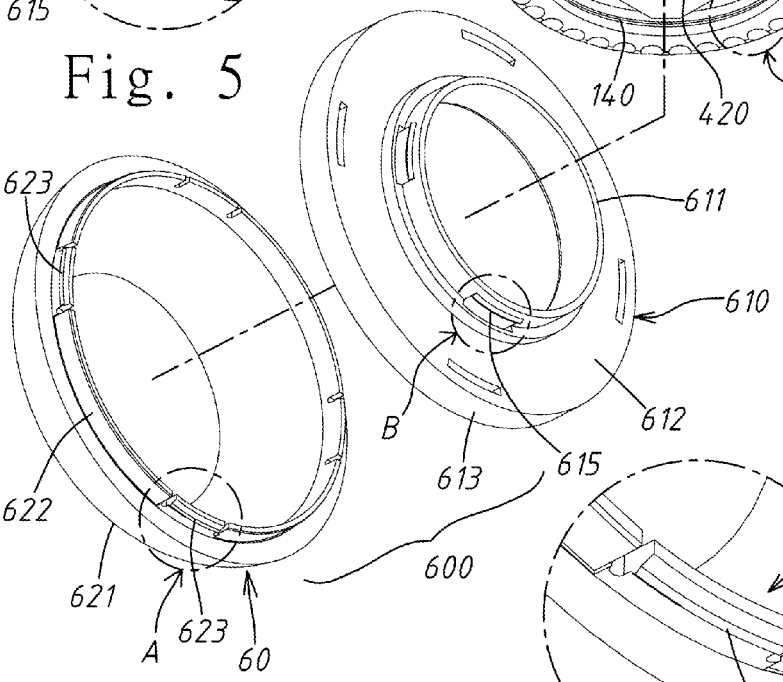
FIG. 3 is a partially exploded view of the multi-directional LED bulb in FIG. 1.
Figure 4:
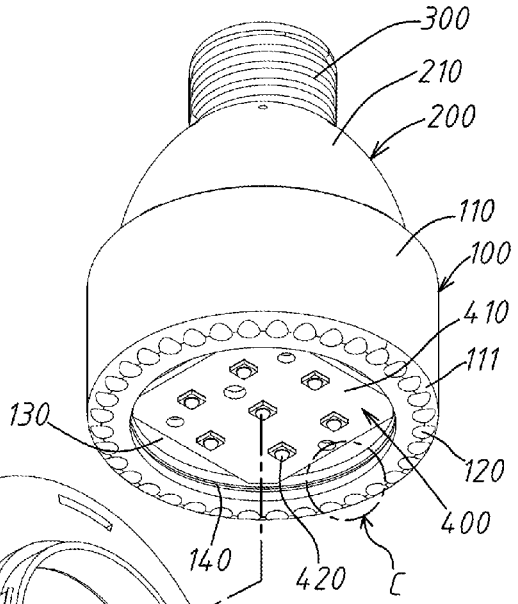
FIG. 4 is an enlarged view of part A of the multi-directional LED bulb in FIG. 3.
Figure 4:
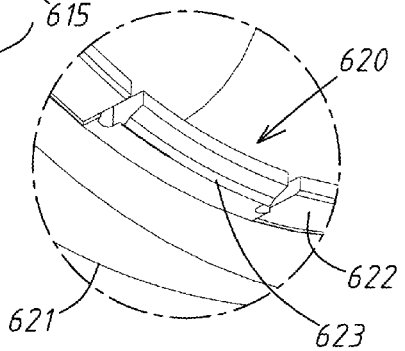
Figure 7:
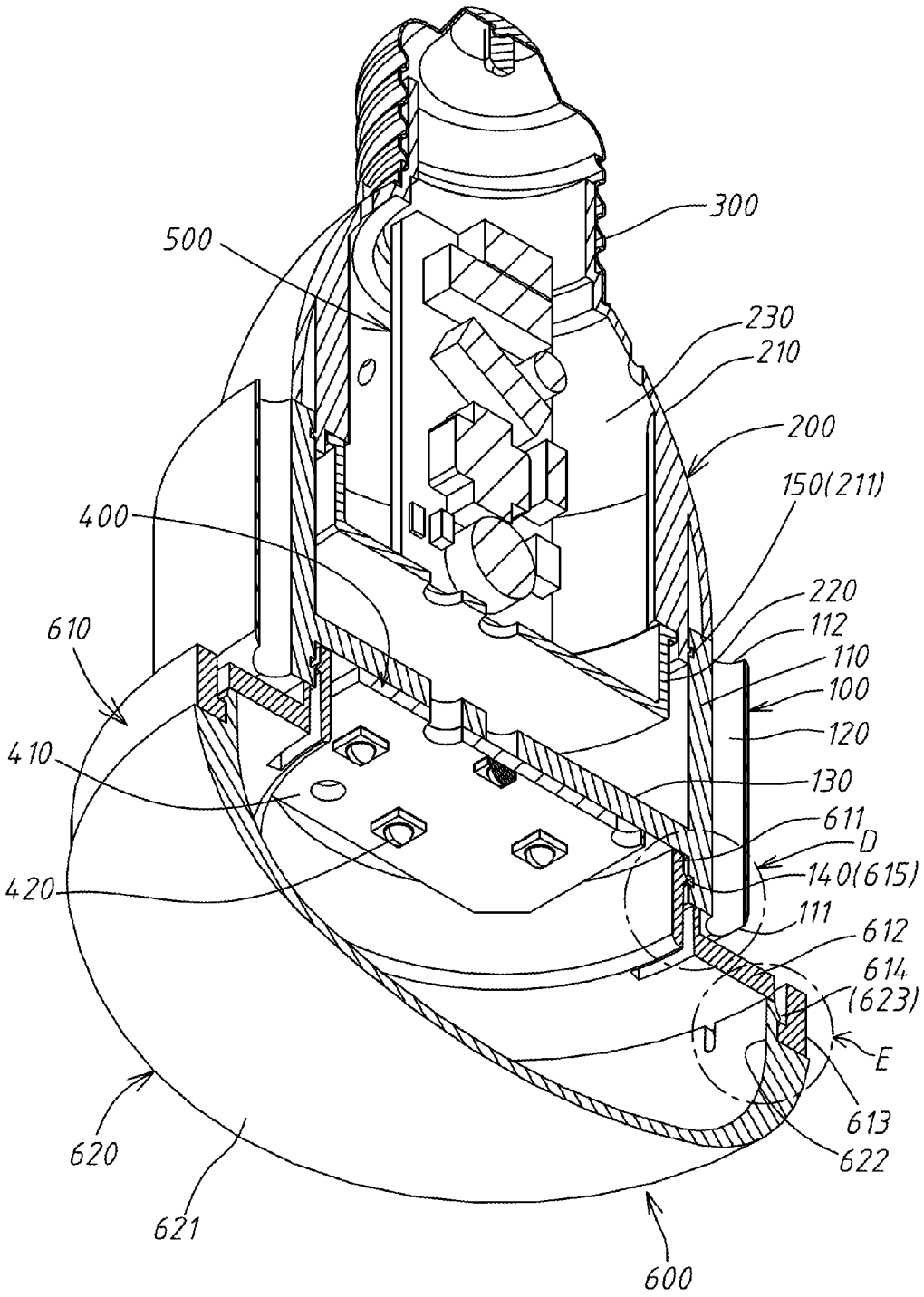
FIG. 7 is a cross-sectional view of the multi-directional LED bulb in FIG. 1.
Figure 8:
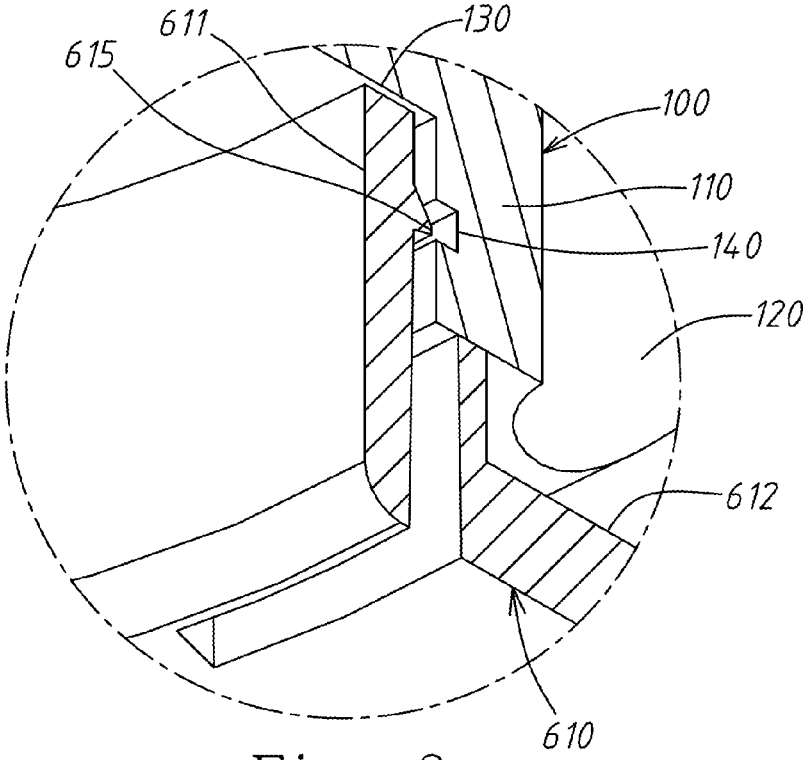
FIG. 8 is an enlarged view of part D of the multi-directional LED bulb in FIG. 7.
Figure 9:
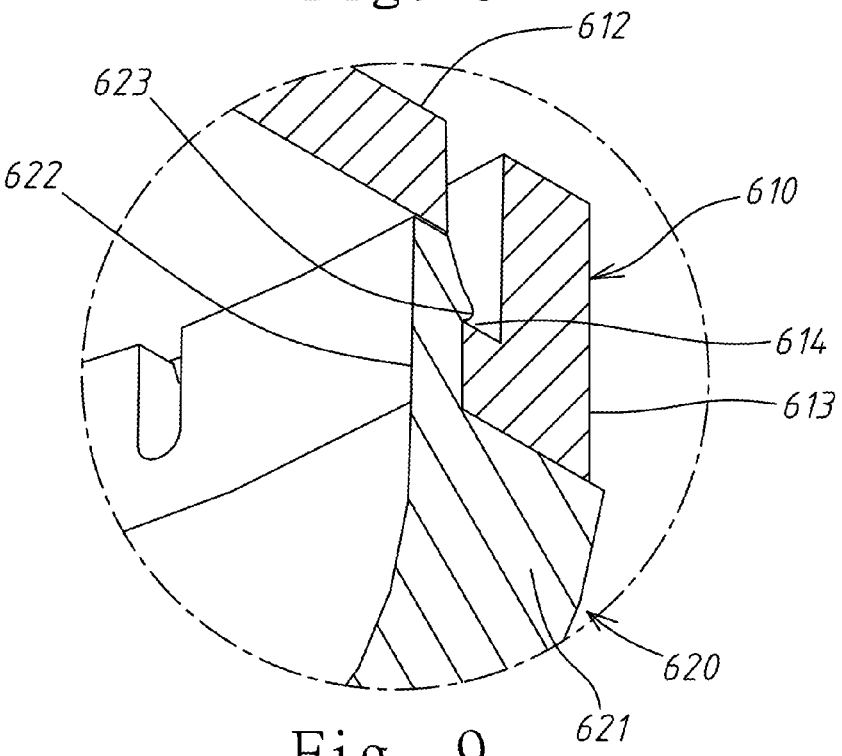
FIG. 9 is an enlarged view of part E of the multi-directional LED bulb in FIG. 7.

Reference will now be made in detail to the present embodiments of the invention, examples of which are illustrated in the accompanying drawings. Wherever possible, the same reference numbers are used in the drawings and the description to refer to the same or like parts.

Referring FIG. 1 to FIG. 9, according to an exemplary embodiment of the present invention, a multi-directional LED lamp includes a cooling cylinder 100, a lamp housing unit 200, a lamp cap 300, a LED lighting unit 400, a driving circuit board 500 and a transparent lampshade unit 600 is disclosed.

The cooling cylinder 100 is made by good heat conducting materials, such as aluminum, copper or its alloy. The cooling cylinder 100 includes an annular wall 110, which has a first outer end 111 and an opposite second outer end 112. The annular wall 110 of the cooling cylinder 100 is penetrated by a plurality of air channels 120 running through the first outer end 111 to the second outer end 112. A transverse carrier plate 130 is disposed between inner walls of the interior of cooling cylinder 100. Besides, a first annular groove 140 is set at a bottom of the inner wall of the annular wall 110 of the cooling cylinder 100 and a second annular groove 150 is set at a top of the inner wall of the annular wall 110 of the cooling cylinder 100.

The lamp housing unit 200 includes an upper lamp housing 210 and a lower lamp housing 220. The lower lamp housing 220 is assembled at a basal plane of the upper lamp housing 210. An interior of the upper lamp housing 210 and an interior of the lower lamp housing 220 form a containing room 230. The lamp cap 300 is assembled at a top of the upper lamp housing 210 of the lamp housing unit 200. The driving circuit board 500 is installed in the containing room 230 of the interior of the lamp housing unit 200, and is electrically connected to the lamp cap 300 and the LED lighting unit 400. A bottom of the upper lamp housing 210 of the lamp housing unit 200 has a plurality of second engaging sections 211 spaced to each other, each of the second engaging sections 211 is engaged with the second annular groove 150 of the cooling cylinder 100.

The LED lighting unit 400 has a substrate 410 and a plurality of LEDs 420 installed on the substrate 410. The LED lighting unit 400 is installed on the basal plane of the transverse carrier plate 130 of the cooling cylinder 100, and facing an opposite end of the lamp cap 300, that is, facing the direction of the transparent lampshade unit 600. Besides passing via the transverse carrier plate 130 and via a surface of the annular wall 110 of the cooling cylinder 100, the heat generated during the operation of the LEDs 420 can also pass by the natural convection of the air channels 120 at the same time.

The transparent lampshade unit 600 is assembled at the bottom of the cooling cylinder 100, and covers the LED lighting unit 400. A cross-sectional area of the transparent lampshade unit 600 is greater than a cross-sectional area of the cooling cylinder 100, to thereby outwardly protrude from the cooling cylinder 100.

The transparent lampshade unit 600 includes an upper transparent lampshade 610 and a lower transparent lampshade 620. The lower transparent lampshade 620 is assembled at the bottom of the upper transparent lampshade 610. Wherein the upper transparent lampshade 610 is a convex lampshade, which includes an upper inner wall 611, a flat shade body 612, and a lower outer wall 613 connected in order, an inner wall of the lower outer wall 613 has a plurality of inner notches 614 spaced to each other. And the lower transparent lampshade 620 is a bowl lampshade, which has a bowl shade body 621 and an annular wall 622 connecting around the bowl shade body 621, the annular wall 622 has a plurality of outer hook bodies 623 spaced to each other, and each of the outer hook bodies 623 is engaged with one of the inner notches 614 of the upper transparent lampshade 610, to combine the upper transparent lampshade 610 and the lower transparent lampshade 620 together. In addition, the upper inner wall 611 of the transparent lampshade unit 600 has a plurality of first engaging sections 615 spaced to each other, which engage with the first annular groove 140 at the bottom of the cooling cylinder 100. Since the transparent lampshade unit 600 is assembled at the cooling cylinder 100 by the upper inner wall 611 of the upper transparent lampshade 610, the flat shade body 612 of the upper transparent lampshade 610 therefore is outwardly protrude from the cooling cylinder 100 a width W.

Figure 10:
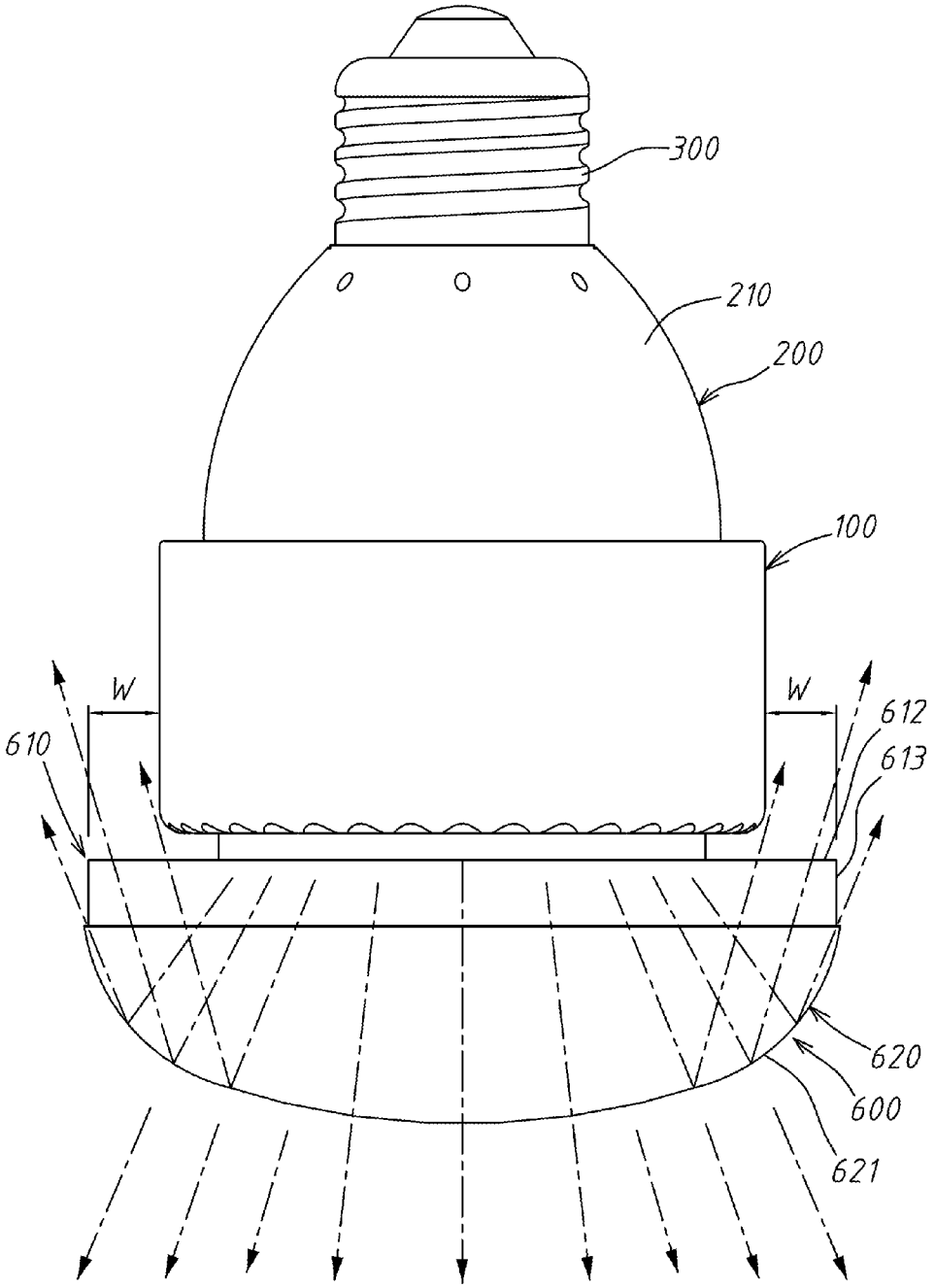
FIG. 10 is a usage schematic diagram of the multi-directional LED bulb in FIG. 1.

Referring to FIG. 10 in conjunction with FIG. 1-FIG. 9, according to an exemplary embodiment of the multi-directional LED lamp of the present invention, since the flat shade body 612 of the upper transparent lampshade 610 of the transparent lampshade unit 600 is not covered by the cooling cylinder 100 at the direction of the lamp cap 300, therefore, the light emitted by the LED lighting unit 400 can radiate in a direction opposite to the lamp cap 300 through the bowl shade body 621 and the annular wall 622 of the lower transparent lampshade 620, a part of the light can also reflect by the bowl shade body 621 and transmits toward a direction of the lamp cap 300 through the flat shade body 612 of the upper transparent lampshade 610, thereby achieving a goal of the multi-directional lighting and solving the problems of a dark area at the direction of the lamp cap 300.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An multi-directional LED lamp, comprising:

a cooling cylinder;

a lamp housing unit, assembled at a top of the cooling cylinder;

a lamp cap, assembled at a top of the lamp housing unit;

a LED lighting unit, installed in an interior of the cooling cylinder;

a driving circuit board, installed in an interior of the lamp housing unit, and electrically connected to the lamp cap and the LED lighting unit; and a transparent lampshade unit, assembled at a bottom of the cooling cylinder and covering the LED lighting unit, a cross-sectional area of the transparent lampshade unit is greater than a cross-sectional area of the cooling cylinder, to outwardly protrude from the cooling cylinder, wherein the transparent lampshade unit comprises an upper transparent lampshade and a lower transparent lampshade, and the lower transparent lampshade is assembled at a bottom of the upper transparent lampshade, and the upper transparent lampshade is a convex lampshade, comprises an upper inner wall, a flat shade body and a lower outer wall connected in order, an inner wall of the lower outer wall has a plurality of inner notches spaced to each other, the lower transparent lampshade is a bowl lampshade, which has a bowl shade body and an annular wall connecting around the bowl shade body, the annular wall has a plurality outer hook bodies spaced to each other, and each of the outer hook bodies are respectively engaged with one of the inner notches.

2. The multi-directional LED lamp of claim 1, wherein the cooling cylinder has an annular wall, the annular wall has a first outer end and a second outer end opposite to the first outer end, the annular wall is penetrated by a plurality of air channels running through the first outer end to the second outer end, a transverse carrier plate is disposed between an inner wall of the interior of the cooling cylinder, the LED lighting unit is installed at a basal plane of the transverse carrier plate.

3. The multi-directional LED lamp of claim 2, wherein a first annular groove is set at a bottom of the inner wall of the annular wall of the cooling cylinder, the upper inner wall of the transparent lampshade unit has a plurality of first engaging sections spaced to each other, each of the first engaging sections is engaged with the first annular groove.

4. The multi-directional LED lamp of claim 2, wherein the lamp housing unit comprises an upper lamp housing and a lower lamp housing, the lower lamp housing is assembled on a basal plane of the upper lamp housing, an interior of the upper lamp housing and an interior of the lower lamp housing form a containing room, wherein the driving circuit board is installed in the containing room.

5. The multi-directional LED lamp of claim 4, wherein a second annular groove is set at a top of the inner wall of the annular wall of the cooling cylinder, a bottom of the upper lamp housing of the lamp housing unit has a plurality of second engaging sections spaced to each other, each of the second engaging sections is engaged with the second annular groove.

6. The multi-directional LED lamp of claim 1, wherein the LED lighting unit comprises a substrate and a plurality of LEDs installed on the substrate.

* * * * *